United States Patent [19]

Yamazaki et al.

[11] Patent Number: 4,571,379

[45] Date of Patent: Feb. 18, 1986

[54] PHOTOGRAPHIC POLYESTER SUPPORTS WITH COPOLYMER SUBBING LAYER

[75] Inventors: Toshiaki Yamazaki; Takanori Nakadate; Kenichi Kitahara; Noboru Fujimori; Morio Kobayashi; Ryuji Shimosaki, all of Hino, Japan

[73] Assignee: Konishiroku Photo Industry Co., Ltd., Tokyo, Japan

[21] Appl. No.: 701,452

[22] Filed: Feb. 13, 1985

Related U.S. Application Data

[63] Continuation of Ser. No. 513,108, Jul. 12, 1983, abandoned.

[30] Foreign Application Priority Data

| | | | |
|---|---|---|---|
| Jul. 23, 1982 | [JP] | Japan | 57-127467 |
| Jul. 26, 1982 | [JP] | Japan | 57-128986 |
| Jul. 27, 1982 | [JP] | Japan | 57-129605 |

[51] Int. Cl.[4] ..... G03C 1/76

[52] U.S. Cl. ..... 430/534; 430/535; 428/483; 428/522; 428/523

[58] Field of Search ..... 430/533, 534, 535; 428/483, 523, 522

[56] References Cited

U.S. PATENT DOCUMENTS

| | | | |
|---|---|---|---|
| 4,128,426 | 12/1978 | Ohta et al. | 430/534 |
| 4,135,932 | 1/1979 | Mann | 430/535 |
| 4,225,665 | 9/1980 | Schadt | 430/535 |
| 4,265,946 | 5/1981 | Yatse et al. | 430/534 |
| 4,328,283 | 5/1982 | Nakadata et al. | 430/534 |
| 4,329,423 | 5/1982 | Ealding et al. | 430/534 |

*Primary Examiner*—Jack P. Brammer

*Attorney, Agent, or Firm*—Frishauf, Holtz, Goodman & Woodward

[57] ABSTRACT

Photographic support having coated over a polyester support as a subbing layer a specific aqueous copolymer composition, said subbing layer being formed by coating aqueous composition containing copolymer substantially composed of a specific combination of three or four monomer components. Said photographic support has firm adhesive property, good flatness and other advantages.

10 Claims, No Drawings

PHOTOGRAPHIC POLYESTER SUPPORTS WITH COPOLYMER SUBBING LAYER

This application is a continuation of application Ser. No. 513,108, filed July 12, 1983, now abandoned.

This invention relates to a photographic support containing a subbing layer. More particularly, it is concerned with a photographic support or support having coated over a polyester support as a subbing layer a specific aqueous copolymer composition so as to accomplish a firm adhesion of such hydrophilic colloid layer as a photosensitive emulsion layer, a backing layer etc. over the said support.

A polyester film has excellent physical properties as a support for silver halide photographic materials and the like and thus have recently been widely utilized with an increased demand therefor. However, a polyester film has a very high hydrophobic property and then has after encountered a difficulty to provide a firm adhesion between such a support and a hydrophilic colloid layer, for example, a photographic gelatin layer containing as a binder such a material as gelatin and the like. Hitherto, there have been proposed a number of subbing methods for adhesing a support with a hydrophilic colloid layer in a photographic material using a polyester film. For a firm adhesion of a hydrophilic layer, especially a photographic gelatin layer, a swelling agent or a dissolving agent for polyester film should be frequently applied in every method. However, where a subbing composition containing the swelling agent or dissolving agent is coated over a polyester film, flatness of the support tends to be damaged during a subbing step and further disadvantages are found in safety and hygiene of operation in view of harmful organic solvents employed in most of these swelling agents or dissolving agents.

Then, subbing techniques for polyester film without employing any swelling agents or dissolving agents have been proposed in the art. As one of such techniques, there has been proposed a surface active support treated by chemicals, mechanical means, corona discharge, flame, ultraviolet ray, microwave, glow discharge, active plasma, laser, mixed acid, ozone oxidation and the like as a polyester film having a chemically or physically treated surface, which is disclosed in U.S. Pat. Nos. 2,943,937, 3,475,193, 3,615,557, 3,590,107; British Pat. No. 1,215,234; Japanese Patent Published Application Nos. 13672/1978 and 18469/1980. However, such surface-treated polyester films can show an increased adhesive property with a photographic protective colloid layer, which is believed to be upon the points that an inherently hydrophobic film surface retains some polar groups, that a thin layer, which is a negative factor to adhesion of a polar surface, is removed and so on. But, said surface-treated polyester films can show no such satisfactory adhesive strength.

Moreover, there has been proposed a polyester film having coated thereon an aqueous coating composition layer after surface treatment to increase adhesivity with a photographic hydrophilic colloid layer. This aqueous coating composition layer, i.e., the so-called subbing layer should have a sufficient adhesivity with both a polyester film and a photographic hydrophilic colloid layer. In particular, it has been generally attempted for a sufficient adhesion between the subbing layer and the photographic hydrophilic collid layer to incorporate a hydrophilic group or a reactive group into a resin component of a subbing layer (hereinafter referred to as "a subbing resin"). As the hydrophilic or reactive group, there may be mentioned acids, for example, acrylic acid, itaconic acid, a semi-alkyl ester of itaconic acid and the like; epoxy groups, for instance, glycidyl acrylate, glycidyl methacrylate; N-alkanol group, for example, N-methylol acrylamide, hydroxymethlated N-(1,1-dimethyl-3-oxobutyl)acrylamide and the like; hydroxy group, for example, hydroxyethyl methacrylate, hydroxyethyl acrylate and the like.

Of the foregoing, examples of the subbing layer containing the subbing resin of the above acid component are disclosed in Japanese Patent Publication No. 3564/1973, Japanese Patent Published Application Nos. 1123/1971 and 1718/1975, European Patent No. 1484, Japanese Patent Published Application Nos. 6151/1979 and 39536/1975, U.S. Pat. No. 3,545,972 and so on. However, a polyester film having a subbing layer of the subbing resin containing the acid component showed an insufficient adhesivity of a photographic hydrophilic protective colloid layer when developed.

Examples of the subbing layer of the subbing resin containing the above epoxy group component are disclosed in Japanese Patent Publication No. 9629/1959, Japanese Patent Published Application Nos. 58469/1976, 104913/1977, 27918/1976, 19786/1977, 30121/1979 and 121323/1976, British Patent No. 1,168,171, Japanese Patent Published Application No. 69138/1980 and so on. However, all epoxy group components of glycidyl methacrylate, glycidyl acrylate and the like tends to be self-crosslinking and readily decomposed, modified during synthesis of the subbing resin or storage of a synthesis liquid and thus show an unsatisfactory stability of the synthesis liquid or a subbing liquid of an aqueous composition containing the subbing resin (hereinafter referred to as "a subbing liquid").

Examples of the subbing layer of the subbing resin containing the above N-alkanol group component are disclosed in French Patent No. 140,408, Japanese Patent Published Application No. 131516/1976, British Patent No. 1,178,597, Japanese Patent Publication No. 3054/1982 and so on. However, N-alkanol acrylamidesas disclosed therein are highly self-crosslinking and undergo crosslinking during synthesis of the subbing resin or storage of the synthesis liquid and thus show an unsatisfactory stability of the synthesis liquid and the subbing liquid.

As examples of the subbing layer of the subbing resin containing the above hydroxy group component, a subbing layer containing as copolymer components for the subbing resin a hydroxy group-containing monomer and glycidyl acrylate and/or glycidyl methacrylate is disclosed in Japanese Patent Published Application Nos. 69138/1980 and 19786/1977. Also, Japanese Patent Published Application No. 135526/1976 discloses a subbing layer containing as copolymer components for the subbing layer a hydroxy-containing vinyl monomer and vinylidene chloride and/or vinyl chloride; Japanese Patent Published Application No. 123139/1976 discloses a subbing layer containing as copolymer components for the subbing layer a hydroxy group-containing monomer and a diolefin monomer; and Japanese Patent Published Application No. 113868/1974 discloses a subbing layer containing a hydroxy group-containing monomer and an ester of acrylic acid or methacrylic acid. However, these subbing layers are also said to be satisfactory for the subbing layer or resin. More specifically, the subbing layer containing as subbing resin components a hydroxy group-containing monomer and glycidyl acrylate or glycidyl methacrylate may tend to precipitate the subbing resin in synthesis and subbing liquids by reaction of the epoxy group with the hydroxy group under certain conditions and show an unstable stability. Also, the subbing layer containing as subbing resin components a hydroxy group-containing vinyl monomer and vinylidene chloride and/or vinyl chloride tends to eliminate hydrochloric acid from the vinylidene chloride and vinyl chloride to change pH value of the synthesis or subbing liquid and provide an unstable adhesivity. Also, in the subbing layer containing subbing resin components a hydroxy group-containing monomer and a diolefin monomer, crosslinking of the diolefin tends to occur when the subbing resin is synthesized and its control is difficult and a subbing layer with a constant performance is difficult to be available, which results in an unstable adhesivity when developed. And, it is seen in the subbing layer containing a copolymer of a hydroxy group-containing monomer with an ester of acrylic acid or methacrylic acid that a synthesis liquid and a subbing liquid are mechanically unstable and copolymers are precipitated under certain conditions and thus the subbing layer with a stable performance is difficult to be available.

As explained above, a photographic polyester film containing the subbing resin having a hydrophilic group or a reactive group in a subbing layer is not always satisfactory in stability when prepared and subbing performance.

On the other hand, as examples of the subbing layer containing not always the aforesaid hydrophilic group or reactive group in the subbing resin, Japanese Patent Publication No. 970/1982 discloses a subbing layer wherein the subbing resin containing styrene as a main component is coated over a polyester film and then subjected to corona discharge treatment. However, the subbing layer shows an insufficient film-forming property of the subbing resin, tends to show a poor transparency of the subbed polyester film and it is then difficult to obtain a highly transparent subbed polyester film constantly.

Now, there has been proposed a technique for providing a polyester film with a resin layer, which is seemingly available for photographic purposes. However, a subbing layer for photography requires such performances widely different from those for other uses and is alike to in appearance but quite different in nature from other polyester films. For instance, Japanese Patent Publication No. 19879/1971 discloses an adhesive film wherein an aqueous dispersion of a copolymer containing an acrylic acid ester and a hydroxy group-containing vinyl monomer is coated over a film and then an easily sealing polymer is coated thereover. However, this subbing layer has the feature that an intermediate anchor coating layer is to be located in view of adhesion of the film with a hydrophobic, easily sealing polymer, e.g. a copolymer of vinylidene chloride with acrylic acid ester. Therefore, this subbing layer is quite different in technical concept from a photographic subbing layer having adhered a film to a photographic hydrophilic collid layer. In this connection, the subbing layer according to the technique as disclosed in the above Japanese Patent Publication No. 19879/1971 does show a quite insufficient adhesive property to a photographic hydrophilic colloid layer.

The present inventors have taken notice of the subbing resin containing a hydrophilic group or a reactive group and made earnest studies on a subbing layer which would be constantly manufacturable and capable of providing excellent subbing performances. As a result, it has been found that the aforesaid drawbacks can be eliminated by the use of a specific combination of monomers constituting the subbing resin.

The first object of this invention is to provide a photographic support having a firm adhesive property between a polyester film and a photographic hydrophilic colloid layer.

The second object of this invention is to provide a photographic support, without discharging harmful organic solvents and so on into exhaut air or drain and producing any environmental pollution due to no essential need for use of organic solvent swelling agents or dissolving agents for polyesters.

The third object of this invention is to provide a photographic support with a good flatness.

The fourth object of this invention is to provide a photographic support which does not require the use of swelling agents or dissolving agents for polyesters and shows no poor flatness and transparency of a polyester film derivable from the said use, nor a poor transparency upon coated subbing layer.

The fifth object of this invention is to provide a photographic support which has a subbing layer composed of the subbing resin producible constantly and easily.

The sixth object of this invention is to provide a photographic support having a subbing layer composed of the subbing resin with a good storage stability.

The seventh object of this invention is to provide a photographic support which is prepared by the use of a subbing liquid with good storage stability and mechanical stability; namely to provide a photographic support wherein the present subbing resin does not require self-crosslinking, decomposable copolymer components and then such unfavourable changes as modification of the subbing resin during the synthesis or storage thereof or the storage of the subbing liquid, physical properties, e.g. pH of the subbing resin or liquid would not occur and also the present subbing resin is mechanically very stable so that no aggregation may occur during the synthesis thereof or coating of the subbing liquid.

The eighth object of this invention is to provide a photographic support which can be constantly prepared without any variation of subbing performance upon even change in coating and drying conditions during the subbing step.

The ninth object of this invention is to provide a photographic support which would not adversely affect various photographic hydrophilic colloid layers, in particular, a photographic emulsion layer.

The present inventors have found out that a satisfactory result can be attained only if a hydrophilic group-containing monomer and a hydrophobic monomer are in a strictly specific combination in the subbing resin and then completed the present invention upon the aforesaid finding. The above-recited objects of this invention can be accomplished by the present photographic support which comprises a subbing layer over at least one side of a polyester support or support, said subbing layer being obtainable by coating an aqueous composition containing a copolymer substantially composed of a monomer having the general formula (I); a monomer of the general formula (II); and a monomer of the formula (III) and/or a monomer of the general formula (IV):

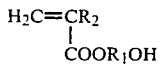

(I)

(wherein $R_1$ is an alkylene group having 2 to 4 carbon atoms and $R_2$ is a hydrogen atom or a methyl group);

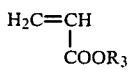

(II)

(wherein $R_3$ is a straight alkyl group having 2 to 8 carbon atoms);

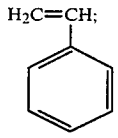

(III)

and

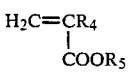

(IV)

(wherein $R_4$ is a hydrogen atom or a methyl group and $R_5$ is a straight or branched alkyl group having 2 to 8 carbon atoms, provided that when $R_4$ is a hydrogen atom, $R_5$ is the said branched alkyl group and, when $R_4$ is a methyl group, $R_5$ is the said straight alkyl group).

Illustrative examples of the monomer of the general formula (I) in the copolymer employable in this invention may include, for example, 2-hydroxyethyl acrylate, 2-hydroxyethyl methacrylate, 2-hydroxypropyl acrylate, 2-hydroxypropyl methacrylate, 2,2-dimethylhydroxypropyl acrylate, 5-hydroxypentyl acrylate and the like. Where this monomer(I) is used in a too small amount, the copolymer may have a poor mechanical stability, while adhesivity may become poor if too excess. Therefore, the monomer(I) is preferable employed at a ratio to the copolymer of 3–45% by weight, most preferably 10–35% by weight.

Illustrative examples of the monomer of the general formula(II) in the copolymer employable in this invention may include, for example, propyl acrylate, butyl acrylate, pentyl acrylate, hexyl acrylate, octyl acrylate and the like. Where the monomer(II) is used in a too small amount, the subbing layer may have a poor adhesivity, while constant synthesis is not available if too excess. Therefore, the monomer(II) is preferably employed at a ratio to the copolymer of 10–45% by weight, most preferably 15–40% by weight.

The monomer(III), namely styrene monomer, in the copolymer employable in the present invention, when combined with the above-mentioned monomers(I) and (II), can exhibit effects to make synthesis constant and stabilize subbing performance. If the styrene monomer(III) is used in a too small amount, both synthesis liquid and subbing liquid may show a poor mechanical stability, while the subbing layer may show a poor transparency if too excess. Therefore, the monomer(III) is preferably employed at a ratio of 10–70% by weight, most preferably 20–50% by weight.

The monomer of the general formula(IV) in the copolymer employable in this invention may be illustrated, for example, with isopropyl acrylate, t-butyl acrylate, sec-butyl acrylate, isobutyl acrylate, 2-ethylhexy acrylate, t-octyl acrylate, ethyl methacrylate, propyl methacrylate, isopropyl methacrylate, butyl methacrylate, octyl methacrylate and the like. Effects and ratios of the monomer(IV) are just the same as stated above with regard to the styrene monomer(III).

Further, the monomers(III) and (IV) may be applied in the copolymer alone or in combination therewith, as explained hereinabove. If both monomers(III) and (IV) are used in combination, there can be seen the same effects as used alone. In this instance, however, the styrene monomer(III) is preferably used at a ratio of 5–45% by weight, most preferably 10–30% by weight: Preferably, the total of the monomers(III) and (IV) should be within 10–70% by weight.

Preferable combinations of the above monomer components (I), (II) and (III) and/or(IV) are illustrated below.

- 2-hydroxyethyl methacrylate-propyl acrylate-styrene;
- 2-hydroxyethyl methacrylate-butyl acrylate-styrene;
- 2-hydroxyethyl methacrylate-hexyl acrylate-styrene;
- 2-hydroxypropyl methacrylate-butyl acrylate-styrene;
- 2-hydroxypropyl methacrylate-hexyl acrylate-styrene;
- 2-hydroxyethyl acrylate-propyl acrylate-styrene;
- 2-hydroxyethyl acrylate-butyl acrylate-styrene;
- 2-hydroxypropyl acrylate-propyl acrylate-styrene;
- 2-hydroxypropyl acrylate-butyl acrylate-styrene;
- 2-hydroxyethyl methacrylate-butyl acrylate-t-butyl acrylate;
- 2-hydroxyethyl acrylate-butyl acrylate-isobutyl acrylate;
- 2-hydroxyethyl methacrylate-butyl acrylate-sec-butyl acrylate;
- 2-hydroxyethyl methacrylate-butyl acrylate-butyl methacrylate;
- 2-hydroxyethyl methacrylate-butyl acrylate-propyl methacrylate;
- 2-hydroxyethyl methacrylate-propyl acrylate-t-butyl acrylate;
- 2-hydroxypropyl methacrylate-butyl acrylate-t-butyl acrylate;
- 2-hydroxypropyl methacrylate-butyl acrylate-butyl methacrylate;
- 2-hydroxyethyl acrylate-butyl acrylate-t-butyl acrylate;
- 2-hydroxyethyl methacrylate-butyl acrylate-t-butyl acrylate-styrene;
- 2-hydroxyethyl methacrylate-butyl acrylate-isobutyl acrylate-styrene;
- 2-hydroxyethyl methacrylate-butyl acrylate-sec-butyl acrylate-styrene;
- 2-hydroxyethyl methacrylate-butyl acrylate-butyl methacrylate-styrene;
- 2-hydroxyethyl methacrylate-butyl acrylate-propyl methacrylate-styrene;
- 2-hydroxyethyl methacrylate-propyl acrylate-t-butyl acrylate-styrene;
- 2-hydroxypropyl methacrylate-butyl acrylate-t-butyl acrylate-styrene;
- 2-hydroxypropyl methacrylate-butyl acrylate-butyl methacrylate-styrene;
- 2-hydroxyethyl acrylate-butyl acrylate-t-butyl acrylate-styrene; and the like.

The copolymer, which may be employed in this invention, may be composed substantially of the above 3 or 4 monomer components, but a small amount of other monomers may be incorporated into the copolymer formulation to the extent that the present object may not be disturbed.

The copolymer employable in this invention may be synthesizable according to well-known emulsion polymerization processes. Further, in emulsion copolymerization of these monomers, it is advantageous to employ a surface active agent for emulsion polymerization. For instance, there may be favourably employed protective colloids, e.g. polyvinyl alcohol, partially saponified vinyl acetate, polyethylene oxide, polyethylene oxide derivatives, hydroxyethyl cellulose, methyl cellulose, styrene-maleic acid copolymers, vinyl acetate-maleic acid copolymers, methyl vinyl ether-maleic acid copolymers; cationic surface active agents, e.g. dodecyltrimethyl ammonium chloride, tetradecyl dimethyl benzyl ammonium chloride, dodecyl isoquinolinium bromide; anionic surface active agents, e.g. sodium laurylsulfate, sodium dodecylbenzenesulfonate, sodium dodecylbenzenecarboxylate; and the like. Also nonionic surface active agents may be further added, as required.

As a polymerization initiator, there may be employed any organic or inorganic peroxides or peracids, for example, peracetic acid, acetyl peroxide, benzoyl peroxide, benzoylacetyl peroxide, lauryl peroxide, hydrogen peroxide, percarbonates, persulfates, perborates and the like. In addition, there may be also used inorganic, oxygen-containing, oxidative sulfur compounds, for example, sulfur dioxide, sodium hydrogensulfite, sodium sulfite, sodium metasulfite, ammonium sulfite; and water-soluble, aliphatic tertiary amines, for example, triethanolamine, diethanolamine and the like.

The present copolymer may be dispersed into an aqueous dispersion medium in the form of fine grains to form an aqueous composition of the copolymer and apply it as the subbing liquid. Based upon the intended purpose, any portion of water may be replaced with a water-miscible organic solvent such as methanol, acetone and so on. The present copolymer obtained by emulsion polymerization may be given in the form of an aqueous dispersion of fine emulsion polymerizate grains, namely "latex".

The aqueous composition of a copolymer containing the present copolymer (i.e. the subbing liquid) may be preferably applied by dilution of the present copolymer, as required, with water or a water-miscible organic solvent to a solid content of the copolymer of 0.1–40% by weight, which may be varied depending upon the purposes to be desired, the coating techniques to be applied.

The subbing liquid containing as a main component the present copolymer latex, i.e. the subbing resin thus prepared contains the said copolymer component at 0.1–40% by weight and, if necessary, may further contain an additive, e.g. a surface active agent, a hydrophilic organic colloid, a matting agent, a lubricant, an antistatic agent, a crosslinking agent and the like. As the crosslinking agent, there may be employed the hardening agent for photographic gelatin, e.g. aldehyde compounds such as formaldehyde, glyoxal; ethyleneimine group-containing compounds such as mucochloric acid, tetramethylene-1,4-bis(ethyleneurea), hexamethylene-1,6-bis(ethyleneurea); active vinyl compounds such as bisacryloyl urea, metaxylenevinylfulfonic acid; methanesulfonic acid esters such as trimethylene-1,3-bismethanesulfonic acid ester; active halogen-containing compounds such as 2-methoxy-4,6-dichlorotriazine; epoxy group-containing compounds such as bisphenol glycidyl ether; isocyanates; and the like. If these agents, there are most preferably used the ethyleneimine group-containing compounds, the methanesulfonic acid esters and the active halogen-containing compounds.

The above subbing liquid may be coated over a polyester film. The term "polyester" as used herein is meant to indicate the polyester having as main components an aromatic dibasic acid and a glycol; wherein representative examples of the dibasic acid may include terephthalic acid, isophthalic acid, $\rho$-$\beta$-oxyethoxybenzoic acid, diphenylsulfonedicarboxylic acid, diphenoxyethanedicarboxylic acid, adipic acid, sebacic acid, azelaic acid, 5-sodiumsulfoisophthalic acid and the like, while examples of the glycol may include ethylene glycol, propylene glycol, butanediol, neopentylene glycol, 1,4-bisoxyethoxybenzene, bisphenol A, diethylene glycol, polyethylene glycol and the like.

Of the polyesters derived from the above components, polyethylene terephthalate is most preferable in view of easy availability.

The polyester support or support which may be employed in this invention may be any of those, whose surface is composed of the polyester, and also any of other supports wherein the poyester is placed thereover. For instance, there may be employed a cellulose triacetate film, a polystyrene film, a polycarbonate film, a polypropylene film or a film coated with said polymers; a glass plate; a baryta paper; a resin-treated paper such as polyethylene-laminated paper; a synthetic paper; a metal plate; various polyester-film-laminated transparent, translucent or opaque supports; and the like.

A thickness of the polyester is not restricted, but advantageously of about 12–500$\mu$, preferably about 40–200$\mu$ in view of ready handling and general purpose. Particularly, a biaxially oriented, crystalline polyester is preferable in view of stability, strength and others.

Prior to coating of the subbing liquid over a polyester film, it is preferable to make the polyester film surface hydrophilic by various surface activated treatment. As the surface activated treatment, there may be mentioned, for example, treatment with oxidizing agent solution as disclosed, e.g. in U.S. Pat. No. 2,943,937; treatment with ultraviolet ray as disclosed in U.S. Pat. No. 3,475,193; treatment with electric discharge of corona discharge as disclosed in U.S. Pat. No. 3,615,557; treatment with active gas irradiation as disclosed in British Patent No. 1,215,234; treatment with flame as disclosed in U.S. Pat. No. 3,590,107; and the like.

The above subbing liquid can be coated over a polyester film according to well-known methods. For instance, coating over a polyester film can be accomplished by means of, for example, curtain coating, reverse roll coating, fountain air doctor coating, slide hopper coating, estrusion coating, dip coating and the like. A coated amount of the component is preferably 0.01–5 g/m$^2$, most preferably 0.03–2 g/m$^2$.

Drying of the subbing liquid after coating can be effected according to well-known methods. For instance, drying with hot air, infrared ray, heater roll, microwave and the like may be applied.

It is preferable in this invention that an upper layer is further coated over the subbing layer. As the upper layer, natural hydrophilic organic colloids, e.g. well-known geratin, casein etc; synthetic hydrophilic organic colloids; antistatic agents, for example, an aqueous solution of a hydrophilic polymer as disclosed in, for example, Japanese Patent Publications Nos. 24159/1971, 23828/1974, Japanese Patent Published Application No. 93165/1973 and so on may be coated. The upper layer liquid may also contain a matting agent, a hardening agent, a surface active agent and the like. Coating and drying of the upper layer liquid can be effected by any well-known methods, similarly to the lower layers.

Before coating of such subbing layers and, if necessary, coating liquid for the upper layer or after drying, surface treatment may be applied by any well-known methods; e.g. treatment with flaming, plasma, corona discharge, glow discharge, ultraviolet irradiation and so on.

The present photographic support having the subbing layer or substratum at least over one side thereof may be coated over at least one side thereof with a photographic hydrophilic colloid layer by a conventional method. Illustratively, there may be coated a variety of photosensitive layer-forming compositions, for example, a silver halide photographic emulsion, a photosensitive diazo composition, a gelatin composition containing an antihalation agent, a gelatin backing composition for controlling a color balance of a support film. The photographic material thus prepared has an excellent adhesivity and a photographic layer is not frilled from a support, even when photographic processing, e.g. developing is applied, without any adverse effect on photographic performance.

This invention will be more fully illustrated by way of the following examples, but they are not limiting the present embodiments. All parts are given by weight hereinbelow unless otherwise indicated.

Representative process for preparing the copolymer employable in this invention will be given below:

SYNTHESIS EXAMPLE 1

| | |
|---|---|
| Hydroxyethyl methacrylate | 75 parts |
| Butyl acrylate | 105 parts |
| Styrene | 120 parts |
| Sodium dodecylbenzenesulfonate | 6 parts |
| Ammonium persulfate | 1 parts |
| Water | 700 parts |

Water was added to an open vessel equipped with a cooling pipe. After evacuation, the above materials were charged therein and emulsion polymerization was carried out at 80° C. for 5 hours to afford the subbing resin having a dry solid content of 30% by weight.

SYNTHESIS EXAMPLES 2–14

Following the same procedures as in the above Synthesis Example 1, there were prepared the copolymer latexes (the subbing resins) of the compositions as disclosed in the following examples.

SYNTHESIS EXAMPLE 15

| | |
|---|---|
| 2-Hydroxyethyl methacrylate | 75 parts |
| Butyl acrylate | 120 parts |
| t-Butyl acrylate | 105 parts |
| Sodium dodecylbenzenesulfonate | 6 parts |
| Ammonium persulfate | 1 part |
| Water | 700 parts |

Following the same procedures as in the above Synthesis Example 1 except that the above formulation was used, there was prepared the subbing resin.

SYNTHESIS EXAMPLES 16–24

Following the same procedures as in the above Synthesis Example 1, there were prepared the copolymer latexes (the subbing resins) of the compositions as disclosed in the following examples.

SYNTHESIS EXAMPLE 25

| | |
|---|---|
| 2-Hydroxyethyl methacrylate | 75 parts |
| Butyl acrylate | 90 parts |
| t-Butyl acrylate | 75 parts |
| Styrene | 60 parts |
| Sodium dodecylbenzenesulfonate | 6 parts |
| Ammonium persulfate | 1 part |
| Water | 700 parts |

Following the same procedures as in the above Synthesis Example 1 except that the above formulation was used, there was prepared the subbing resin.

SYNTHESIS EXAMPLES 26–37

Following the same procedures as in the above Synthesis Example 1, there were prepared the copolymer latexes (the subbing resins) of the compositions as disclosed in the following examples.

In the following example, there were employed the evaluation methods as defined below:

(1) Adhesivity test (i) Adhesion test of dry film

Checkerboard patterns were slightly indented onto the emulsion surface of a sample with a razor and adhesive cellophane tape was pressed thereover. Thereafter, the said tape was rapidly peeled away. Residual ratio of the emulsion film to adhesion area of the said tape at that time was measured and represented in terms of percentages.

(ii) Adhesion test of treated film

Checkerboard patterns were indented onto the emulsion surface of a sample in a processing bath with a sharp drill-like nip and the indented surface was rubbed. Residual ratio of the emulsion film was measured and represented in terms of percentages. Values of not less than 80% can be evaluated as practically acceptable.

(2) Transparency test

A support was measured by means of a turbidmeter (manufactured by Tokyo Denshoku K.K. Japan, Model T-2600DA) and transparency was represented in terms of percentages. Values of not more than 1% can be evaluated as practically acceptable.

(3) Mechanical stability test

A latex liquid was agitated in a vessel with a spindle rotating at a high speed of 14000 rpm by the use of a high speed agitation tester (manufactured by Kamishima Seisakusho, Japan) according to the provision of JIS K6381. The period of time until aggregate was formed was measured and represented in minutes. Values of not less than 30 minutes can be evaluated as practically acceptable.

EXAMPLE 1

A biaxially oriented and thermally set polyethylene terephthalate film of 100 μ was subjected to corona discharge treatment of 30 W/m²/min. Then, a subbing liquid, which was composed of 10 cc of the subbing resin of the Synthesis example 1, 20 mg of a surface active agent having the structure

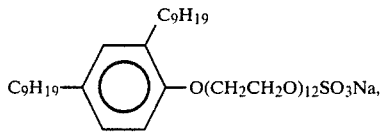

30 mg of hexamethylene-1,6-bisethyleneurea and 90 cc of pure water, was coated thereover at a film thickness of 20 μ and then dried at 100° C. for 1 minute. Then, a coating liquid for an upper layer composed of 1 g of gelatin, 20 mg of saponin and 100 cc of pure water was further coated thereover at a film thickness of 20 μ and dried at 100° C. for 1 minute. The so-obtained subbed polyester film was coated with a printing photosensitive backing layer. As comparative examples, the same procedures as above were repeated except that the subbing liquid copolymers as shown in Table 1 were employed to prepare samples. Test results of samples are summarized in Table 1.

TABLE 1

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 1 | Syn. Ex. 1 | 2-Hydroxyethyl methacrylate | 25 | ≧30 | 0.5 | 100 | 90 |
| | | | Butyl acrylate | 35 | | | | |
| | | | Styrene | 40 | | | | |
| Comparative sample | 1 | Comp. Ex. 1 | 2-Hydroxyethyl methacrylate | 5 | 20 | 0.5 | 60 | 70 |
| | | | Butadiene | 43 | | | | |
| | | | Styrene | 52 | | | | |
| | 2 | Comp. Ex. 2 | 2-Hydroxyethyl acrylate | 25 | 20 | 0.5 | 80 | 80 |
| | | | Ethyl acrylate | 75 | | | | |

Comp. Ex. 1:
From Synthesis Example 1 of Japanese Patent Published Application No. 123139/1976.
Comp. Ex. 2:
From Synthesis Example 5 of Japanese Patent Published Application No. 113868/1974

As apparent from the Table 1, the present sample 1 can be seen to shown excellent values in all four evaluated items. Comparative sample 1 did not show improved adhesion of film when no upper layer coated.

EXAMPLE 2

Following the same procedures as in the Example 1 except that the copolymer latexes indicated in Table 2 were employed, there were prepared subbed polyester films and then a printing photosensitive photographic layer was coated over the subbing layer. Also, comparative samples were prepared similar to the Example 1. Test results are summarized in Table 2.

TABLE 2

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 2 | Syn. Ex. 2 | 3-Hydroxypropyl methacrylate | 30 | ≧30 | 0.5 | 100 | 85 |
| | | | Propyl acrylate | 40 | | | | |
| | | | Styrene | 30 | | | | |
| | 3 | Syn. Ex. 3 | 2-Hydroxyethyl acrylate | 15 | ≧30 | 0.5 | 100 | 90 |
| | | | Hexyl acrylate | 35 | | | | |
| | | | Styrene | 50 | | | | |
| Comparative sample | 3 | Comp. Syn. Ex. 3 | 2-Hydroxyethyl methacrylate | 3 | ≧30 | 1.5 | 30 | 50 |
| | | | Ethyl acrylate | 40 | | | | |
| | | | Methyl methacrylate | 55 | | | | |
| | | | Acrylic acid | 2 | | | | |

Comp. Syn. Ex. 3:
From the paint No. 1 in example of Japanese Patent Publication No. 19879/1971.

Comparative sample 3 showed a poor adhesion of treated film and was unable to be evaluated for its photographic performance, whereas present samples 2 and 3 did not give any adverse effect upon photographic performance. As apparent from Table 2, present samples 2 and 3 can be seen to show excellent values in all four evaluated items.

EXAMPLE 3

A biaxially oriented, thermally set polyethylene terephthalate film of 175 μ was treated with a high pressure mercury lamp of 300 W for 5 minutes. Then, a subbing liquid composed of 1 cc of the subbing resin of the Synthesis example 4, 20 mg of the same surface active agent as in Example 1 and 99 cc of pure water was coated thereover at a film thickness of 20 μ. Thereafter, the same procedures as in Example 1 was repeated. The so-obtained subbed polyester support was coated with an X ray photographic layer. As comparative sample, a polyethylene terephthalate film was coated with a butyl acrylate-styrene copolymer latex, dried and treated with corona discharge of 30 W/m² min. Onto this film was directly coated an X ray photographic layer. Test results are summarized in Table 3.

TABLE 3

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 4 | Syn. Ex. 4 | 2-Hydroxyethyl methacrylate | 10 | ≧30 | 0.5 | 90 | 90 |
| | | | Octyl acrylate | 45 | | | | |
| | | | Styrene | 45 | | | | |
| Comparative sample | 4 | Comp. Syn. Ex. | Butyl acrylate | 30 | 10 | 1.4 | 80 | 80 |
| | | | Styrene | 70 | | | | |

Comp. Syn. Ex. 4:
From the test of the example 10 in Japanese Patent Publication No. 970/1982.

Both present sample 4 and comparative sample 4 did not give any adverse effect upon photographic performance. As apparent from Table 3, present sample 4 can be seen to show excellent values in all four evaluated items.

EXAMPLE 4

Following the same procedures as in Example 1 except that the copolymer latexes (the subbing resins) indicated in Table 4 were employed, there was prepared a subbed polyester film. Over the subbing layer was coated a backing layer for color cut film. The said subbing resin was employed after storage at 23° C. over 2 days and 3 weeks after synthesized. Test results are summarized in Table 4.

TABLE 4

| | | | Copolymer formulation (part by weight) | | Aging after synthesis (day) | Mechanical stability | Trans-parency (%) | Adhesion of treated film (%) | Adhesion of dry film (%) |
|---|---|---|---|---|---|---|---|---|---|
| Present sample | 5 | Syn. Ex. 5 | 2-Hydroxyethyl methacrylate | 40 | 2 | ≧30 | 0.5 | 100 | 90 |
| | | | Butyl acrylate | 20 | 21 | ≧30 | 0.5 | 100 | 90 |
| | | | Styrene | 40 | | | | | |
| Comparative sample | 5 | Comp. Syn. Ex. 5 | 2-Hydroxyethyl methacrylate | 12 | 2 | ≧30 | 0.7 | 90 | 90 |
| | | | Ethyl acrylate | 36 | | | | | |
| | | | Methyl methacrylate | 44 | 21 | 20 | 0.7 | 80 | 70 |
| | | | Glycidyl methacrylate | 8 | | | | | |

Comp. Syn. Ex. 5:
From the copolymer used in Example 21 of Japanese Patent Published Application No. 19786/1977.

As apparent from Table 4, present sample 5 can be seen to show excellent values in all four evaluated items without any degradation with aging.

EXAMPLE 5

Following the same procedures as in Example 1 except that the copolymer latexes (the subbing resins) indicated in Table 5 were employed, there was prepared a subbed polyester film. Over the subbing layer was coated a backing layer for a photogravure printing photosensitive material. Test results are summarized in Table 5.

TABLE 5

| | | Syn. Ex. | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 6 | 1 | 2-Hydroxyethyl methacrylate | 25 | ≧30 | 0.5 | 100 | 90 |
| | | | Butyl acrylate | 35 | | | | |
| | | | Styrene | 40 | | | | |
| | 7 | 6 | 2-Hydroxyethyl methacrylate | 5 | 30 | 0.5 | 95 | 90 |
| | | | Butyl acrylate | 40 | | | | |
| | | | Styrene | 55 | | | | |
| | 8 | 7 | 2-Hydroxyethyl methacrylate | 45 | ≧30 | 0.4 | 100 | 85 |
| | | | Butyl acrylate | 40 | | | | |
| | | | Styrene | 15 | | | | |
| | 9 | 8 | 2-Hydroxyethyl methacrylate | 30 | ≧30 | 0.7 | 100 | 80 |
| | | | Butyl acrylate | 10 | | | | |
| | | | Styrene | 60 | | | | |
| | 10 | 9 | 2-Hydroxyethyl methacrylate | 20 | 30 | 0.4 | 100 | 90 |
| | | | Butyl acrylate | 50 | | | | |
| | | | Styrene | 30 | | | | |
| | 11 | 10 | 2-Hydroxyethyl methacrylate | 40 | ≧30 | 0.4 | 100 | 80 |
| | | | Butyl acrylate | 50 | | | | |
| | | | Styrene | 10 | | | | |
| | 12 | 11 | 2-Hydroxyethyl methacrylate | 10 | ≧30 | 1.0 | 90 | 80 |
| | | | Butyl acrylate | 20 | | | | |

TABLE 5-continued

| Syn. Ex. | Copolymer formulation (part by weight) | | Mechanical stability (min.) | Trans-parency (%) | Adhesion of treated film (%) | Adhesion of dry film (%) |
|---|---|---|---|---|---|---|
| | Styrene | 70 | | | | |

As apparent from Table 5, present samples 1 and 6 to 12 can be seen to show excellent values in all four evaluated items.

EXAMPLE 6

Following the same procedures as in Example 1 except that a subbed polyester film was treated with corona discharge of 30 W/m$^2$ min before coating of an upper layer, there was prepared a subbed polyester film. Over the subbing layer was coated a backing layer for a photogravure printing photosensitive material. Test results are summarized in Table 6.

TABLE 6

| | | Syn. Ex. | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 13 | 7 | 2-Hydroxyethyl methacrylate | 45 | ≧30 | 0.4 | 100 | 95 |
| | | | Butyl acrylate | 40 | | | | |
| | | | Styrene | 15 | | | | |
| | 14 | 10 | 2-Hydroxyethyl methacrylate | 40 | ≧30 | 0.4 | 100 | 90 |
| | | | Butyl acrylate | 50 | | | | |
| | | | Styrene | 10 | | | | |

As apparent from Table 6, present sample 13 and 14 can be seen to show excellent values in all four evaluated items. It can be particularly seen that a far improved adhesion of dry film was achieved, as compared with present samples 8 and 11 of Example 5.

EXAMPLE 7

Following the same procedures as in Example 1 except that the subbing resin of the above Synthesis Example 15 was employed, there were prepared the present sample 15 and comparative samples. Test results are summarized in Table 7.

TABLE 7

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 15 | Syn. Ex. 15 | 2-Hydroxyethyl methacrylate | 25 | ≧30 | 0.5 | 100 | 90 |
| | | | Butyl acrylate | 40 | | | | |
| | | | t-Butyl acrylate | 35 | | | | |
| Comparative sample | 1 | Comp. Syn. Ex. 1 | 2-Hydroxyethyl methacrylate | 5 | 20 | 0.5 | 60 | 70 |
| | | | Butadiene | 43 | | | | |
| | | | Styrene | 52 | | | | |
| | 2 | Comp. Syn. Ex. 2 | 2-Hydroxyethyl acrylate | 25 | 20 | 0.5 | 80 | 80 |
| | | | Ethyl acrylate | 75 | | | | |

As apparent from Table 7, present sample 15 can be seen to show excellent values in all four evaluated item. Comparative sample 1 did not show improved adhesion of film when no upper layer coated.

EXAMPLE 8

Following the same procedures as in Example 1 except that the copolymer latexes (the subbing resins) indicated in Table 8 was employed, there were prepared present samples 16 and 17 and comparative sample. Test results are summarized in Table 8.

TABLE 8

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 16 | Syn. Ex. 16 | 3-Hydroxypropyl methacrylate | 10 | ≧30 | 0.5 | 100 | 90 |
| | | | Butyl acrylate | 40 | | | | |
| | | | t-Butyl acrylate | 50 | | | | |
| | 17 | Syn. Ex. 17 | 2-Hydroxyethyl acrylate | 35 | ≧30 | 0.5 | 100 | 85 |
| | | | Propyl acrylate | 25 | | | | |
| | | | Butyl methacrylate | 40 | | | | |
| Comparative sample | 3 | Comp. Syn. Ex. 3 | 2-Hydroxyethyl methacrylate | 3 | ≧30 | 1.5 | 30 | 50 |
| | | | Ethyl acrylate | 40 | | | | |
| | | | Methyl methacrylate | 55 | | | | |

TABLE 8-continued

| Copolymer formulation (part by weight) | Mechanical stability (min.) | Trans-parency (%) | Adhesion of treated film (%) | Adhesion of dry film (%) |
|---|---|---|---|---|
| Acrylic acid 2 | | | | |

Comparative sample 3 showed a poor adhesion of treated film and was unable to be evaluated for its photographic performance, whereas present samples 16 and 17 did not give any adverse effect upon photographic performance. As apparent from Table 8, present samples 16 and 17 showed excellent values in all four evaluated items.

EXAMPLE 10

Following the same procedures as in Example 1 except that the copolymer latexes (the subbing resins) indicated in Table 10 were employed, there was prepared a subbed polyester support, which was then treated in the same manner as in Example 5. Test results are summarized in Table 10.

TABLE 10

| | | Syn. Ex. | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 19 | 19 | 2-Hydroxyethyl methacrylate | 25 | ≧30 | 0.4 | 100 | 90 |
| | | | Propyl acrylate | 40 | | | | |
| | | | t-Butyl acrylate | 35 | | | | |
| | 20 | 20 | 2-Hydroxyethyl methacrylate | 5 | 30 | 0.4 | 100 | 85 |
| | | | Propyl acrylate | 40 | | | | |
| | | | t-Butyl acrylate | 55 | | | | |
| | 21 | 21 | 2-Hydroxyethyl methacrylate | 45 | ≧30 | 0.4 | 100 | 85 |
| | | | Propyl acrylate | 40 | | | | |
| | | | t-Butyl acrylate | 15 | | | | |
| | 22 | 22 | 2-Hydroxyethyl methacrylate | 30 | ≧30 | 0.5 | 95 | 80 |
| | | | Propyl acrylate | 10 | | | | |
| | | | t-Butyl acrylate | 60 | | | | |
| | 23 | 23 | 2-Hydroxyethyl methacrylate | 20 | 30 | 0.4 | 90 | 90 |
| | | | Propyl acrylate | 50 | | | | |
| | | | t-Butyl acrylate | 30 | | | | |
| | 24 | 24 | 2-Hydroxyethyl methacrylate | 40 | ≧30 | 0.4 | 90 | 80 |
| | | | Propyl acrylate | 50 | | | | |
| | | | t-Butyl acrylate | 10 | | | | |

EXAMPLE 9

Following the same procedures as in Example 1 except that the copolymer latexes (the subbing resins) indicated in Table 9 were employed, there was prepared a subbed polyester film, which was then treated in the same manner as in Example 4. Test results are summarized in Table 9.

TABLE 9

| | | | Copolymer formulation (part by weight) | | Aging after synthesis (day) | Mechanical stability (min.) | Trans-parency (%) | Adhesion of treated film (%) | Adhesion of dry film (%) |
|---|---|---|---|---|---|---|---|---|---|
| Present sample | 18 | Syn. Ex. 18 | 2-Hydroxyethyl methacrylate | 25 | 2 | ≧30 | 0.5 | 100 | 90 |
| | | | Butyl acrylate | 40 | 21 | ≧30 | 0.5 | 100 | 90 |
| | | | sec-Butyl acrylate | 35 | | | | | |
| Comparative sample | 5 | Comp. Syn. Ex. 5 | 2-Hydroxyethyl methacrylate | 12 | 2 | ≧30 | 0.7 | 90 | 90 |
| | | | Ethyl acrylate | 36 | | | | | |
| | | | Methyl methacrylate | 44 | 21 | 20 | 0.7 | 80 | 70 |
| | | | Glycidyl methacrylate | 8 | | | | | |

As apparent from Table 9, present sample 18 can be seen to show excellent values in all four evaluated items without any degradation with aging.

As apparent from Table 10, present samples 19 to 24 can be seen to show excellent values in all four evaluated items.

EXAMPLE 11

Following the same procedures as in Example 6, there were prepared present samples 25 and 26. Test results are summarized in Table 11.

TABLE 11

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 25 | Syn. Ex. 22 | 2-Hydroxyethyl methacrylate | 30 | ≧30 | 0.5 | 100 | 95 |
| | | | Butyl acrylate | 10 | | | | |
| | | | t-Butyl acrylate | 60 | | | | |
| | 26 | Syn. Ex. 23 | 2-Hydroxyethyl methacrylate | 20 | 30 | 0.4 | 100 | 95 |
| | | | Butyl acrylate | 50 | | | | |
| | | | t-Butyl acrylate | 30 | | | | |

As apparent from Table 11, present samples 25 and 26 can be seen to show excellent values in all four evaluated items. It can be particularly seen that a far improved adhesion of dry film was achieved, as compared with present samples 22 and 23 of Example 10.

EXAMPLE 12

Following the same procedures as in Example 1 except that the subbing resin of the above Synthesis Example 25 was employed, there were prepared the present sample 27 and comparative samples. Test results are summarized in Table 12.

TABLE 12

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 27 | Syn. Ex. 25 | 2-Hydroxyethyl methacrylate | 25 | ≧30 | 0.4 | 100 | 95 |
| | | | Butyl acrylate | 30 | | | | |
| | | | t-Butyl acrylate | 25 | | | | |
| | | | Styrene | 20 | | | | |
| Comparative sample | 1 | Comp. Syn. Ex. 1 | 2-Hydroxyethyl methacrylate | 5 | 20 | 0.5 | 60 | 70 |
| | | | Butadiene | 43 | | | | |
| | | | Styrene | 52 | | | | |
| | 2 | Comp. Syn. Ex. 1 | 2-Hydroxyethyl acrylate | 25 | 20 | 0.5 | 80 | 80 |
| | | | Ethyl acrylate | 75 | | | | |

As apparent from Table 12, present sample 27 can be seen to show excellent values in all four evaluated items. Comparative sample 1 did not show an improved adhesion of film when no upper layer coated.

EXAMPLE 13

Following the same procedures as in Example 1 except that the copolymer latexes (the subbing resins) indicated in Table 13 were employed, there were prepared present samples 28 and 29 and comparative sample. Test results are summarized in Table 13.

TABLE 13

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 28 | Syn. Ex. 26 | 3-Hydroxypropyl methacrylate | 15 | ≧30 | 0.4 | 100 | 95 |
| | | | Propyl acrylate | 25 | | | | |
| | | | t-Butyl acrylate | 30 | | | | |
| | | | Styrene | 30 | | | | |
| | 29 | Syn. Ex. 27 | 2-Hydroxyethyl methacrylate | 35 | ≧30 | 0.4 | 100 | 95 |
| | | | Butyl acrylate | 40 | | | | |
| | | | Butyl methacrylate | 15 | | | | |
| | | | Styrene | 10 | | | | |
| Comparative sample | 3 | Comp. Syn. Ex. 3 | 2-Hydroxyethyl methacrylate | 3 | ≧30 | 1.5 | 30 | 50 |
| | | | Ethyl acrylate | 40 | | | | |
| | | | Methyl methacrylate | 55 | | | | |
| | | | Acrylic acid | 2 | | | | |

Comparative sample 3 showed a poor adhesion of treated film and was unable to be evaluated for its photographic performance, whereas present samples 27 and 28 did not give any adverse effect upon photographic performance. As apparent from Table 13, present samples showed excellent values in all four evaluated items.

EXAMPLE 14

Following the same procedures as in Example 3 except that the subbing resin of the Synthesis Example 29 was employed, there was prepared present sample 30. Test results are summarized in Table 14.

TABLE 14

| | | | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 30 | Syn. Ex. 28 | 2-Hydroxyethyl acrylate | 25 | ≧30 | 0.4 | 100 | 95 |
| | | | Octyl acrylate | 10 | | | | |
| | | | Isopropyl acrylate | 40 | | | | |
| | | | Styrene | 25 | | | | |
| Comparative | 6 | Comp. | Butyl acrylate | 30 | 10 | 1.4 | 80 | 80 |

TABLE 14-continued

| | | Copolymer formulation (part by weight) | | Mechanical stability (min.) | Trans-parency (%) | Adhesion of treated film (%) | Adhesion of dry film (%) |
|---|---|---|---|---|---|---|---|
| sample | Syn. Ex. 6 | Styrene | 70 | | | | |

Comp. Syn. Ex. 6:
From the test in Example 10 of Japanese Patent Publication No. 970/1982.

Both present sample 30 and comparative sample 6 did not give any adverse effect upon photographic performance. As apparent from Table 14, present sample can be seen to show excellent values in all four evaluated items.

EXAMPLE 15

Following the same procedures as in Example 4 except that the copolymer latexes (the subbing resins) indicated in Table 15 were employed, there was prepared the present sample 31. Test results are summarized in Table 15.

As apparent from Table 15, present sample can be seen to show excellent values in all four evaluated items without any degradation with aging.

EXAMPLE 16

Following the same procedures as in Example 5 except that the copolymer latexes (the subbing resins) indicated in Table 16 were employed, there were prepared the present samples. Test results are summarized in Table 16.

TABLE 15

| | | | Copolymer formulation (part by weight) | | Aging after synthesis (day) | Mechanical stability (min.) | Trans-parency (%) | Adhesion of treated film (%) | Adhesion of dry film (%) |
|---|---|---|---|---|---|---|---|---|---|
| Present sample | 31 | Syn. Ex. 29 | 2-Hydroxyethyl methacrylate | 25 | 2 | ≧30 | 0.4 | 100 | 95 |
| | | | Propyl acrylate | 30 | | | | | |
| | | | 2-Ethylhexyl methacrylate | 25 | 21 | ≧30 | 0.4 | 100 | 95 |
| | | | Styrene | 20 | | | | | |
| Comparative sample | 5 | Comp. Syn. Ex. 5 | 2-Hydroxyethyl methacrylate | 12 | 2 | ≧30 | 0.7 | 90 | 90 |
| | | | Ethyl acrylate | 36 | | | | | |
| | | | Methyl methacrylate | 44 | 21 | 20 | 0.7 | 80 | 70 |
| | | | Glycidyl methacrylate | 8 | | | | | |

Comp. Syn. Ex. 5:
From the copolymer used in Example 21 of Japanese Patent Published Application No. 19786/1977.

TABLE 16

| | | Syn. Ex. | Copolymer formulation (part by weight) | | Mechanical stability (min.) | Trans-parency (%) | Adhesion of treated film (%) | Adhesion of dry film (%) |
|---|---|---|---|---|---|---|---|---|
| Present sample | 32 | 25 | 2-Hydroxyethyl methacrylate | 25 | ≧30 | 0.4 | 100 | 95 |
| | | | Butyl acrylate | 30 | | | | |
| | | | t-Butyl acrylate | 25 | | | | |
| | | | Styrene | 20 | | | | |
| | 33 | 30 | 2-Hydroxyethyl methacrylate | 5 | 30 | 0.4 | 100 | 95 |
| | | | Butyl acrylate | 40 | | | | |
| | | | t-Butyl acrylate | 40 | | | | |
| | | | Styrene | 15 | | | | |
| | 34 | 31 | 2-Hydroxyethyl methacrylate | 45 | ≧30 | 0.4 | 95 | 90 |
| | | | Butyl acrylate | 20 | | | | |
| | | | t-Butyl acrylate | 20 | | | | |
| | | | Styrene | 15 | | | | |
| | 35 | 32 | 2-Hydroxyethyl methacrylate | 30 | ≧30 | 0.5 | 100 | 90 |
| | | | Butyl acrylate | 10 | | | | |
| | | | t-Butyl acrylate | 25 | | | | |
| | | | Styrene | 35 | | | | |
| | 36 | 33 | 2-Hydroxyethyl methacrylate | 30 | 30 | 0.4 | 100 | 90 |
| | | | Butyl acrylate | 40 | | | | |
| | | | t-Butyl acrylate | 20 | | | | |
| | | | Styrene | 10 | | | | |
| | 37 | 34 | 2-Hydroxyethyl methacrylate | 30 | 30 | 0.4 | 100 | 90 |
| | | | Butyl acrylate | 30 | | | | |
| | | | t-Butyl acrylate | 5 | | | | |
| | | | Styrene | 35 | | | | |
| | 38 | 35 | 2-Hydroxyethyl methacrylate | 20 | ≧30 | 0.6 | 100 | 90 |
| | | | Butyl acrylate | 20 | | | | |
| | | | t-Butyl acrylate | 50 | | | | |
| | | | Styrene | 10 | | | | |
| | 39 | 36 | 2-Hydroxyethyl methacrylate | 15 | ≧30 | 0.7 | 100 | 90 |
| | | | Butyl acrylate | 20 | | | | |
| | | | t-Butyl acrylate | 20 | | | | |
| | | | Styrene | 45 | | | | |

As apparent from Table 16, present samples 32 to 39 can be seen to show excellent values in all four evaluated items.

EXAMPLE 17

Following the same procedures as in Example 6, there were prepared the present samples 40 and 41. Test results are summarized in Table 17.

TABLE 17

| | | | Copolymer formulation (part by weight) | | Mechanical stability (min.) | Transparency (%) | Adhesion of treated film (%) | Adhesion of dry film (%) |
|---|---|---|---|---|---|---|---|---|
| Present sample | 40 | Syn. Ex. 33 | 2-Hydroxyethyl methacrylate | 30 | 30 | 0.4 | 100 | 95 |
| | | | Butyl acrylate | 40 | | | | |
| | | | t-Butyl acrylate | 20 | | | | |
| | | | Styrene | 10 | | | | |
| | 41 | Syn. Ex. 35 | 2-Hydroxyethyl methacrylate | 20 | ≧30 | 0.6 | 100 | 95 |
| | | | Butyl acrylate | 20 | | | | |
| | | | t-Butyl acrylate | 50 | | | | |
| | | | Styrene | 10 | | | | |

As apparent from Table 17, present samples 40 and 41 can be seen to show excellent values in all four evaluated items. It can be particularly seen that a for improved adhesion of dry film was achieved, as compared with present samples 36 and 38 of Example 16.

We claim:

1. A support for use in a light-sensitive photographic material which comprises a subbing layer on at least one side of a polyester substrate, said subbing layer being formed by coating an aqueous composition containing a copolymer consisting essentially of 3 to 45% by weight of a monomer of formula (I) based on the weight of said copolymer

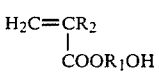

(I)

wherein $R_1$ is an alkylene group having 2 to 4 carbon atoms and $R_2$ is a hydrogen atom or a methyl group;

10 to 45% by weight of a monomer of formula (II) based on the weight of said copolymer

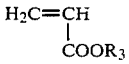

(II)

wherein $R_3$ is a straight chain alkyl group having 2 to 8 carbon atoms; and 10 to 70% by weight based on the weight of said copolymer of at least one monomer selected from the group consisting of (i) a monomer of formula (III)

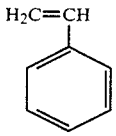

(III)

and (ii) a monomer of formula (IV)

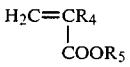

(IV)

wherein $R_4$ is a hydrogen atom or a methyl group and $R_5$ is a straight or branched chain alkyl group having 2 to 8 carbon atoms, provided that when $R_4$ is a hydrogen atom, $R_5$ is said branched chain alkyl group and, when $R_4$ is a methyl group, $R_5$ is said straight chain alkyl group.

2. The support of claim 1, wherein said copolymer consists essentially of said monomers (I), (II) and (III).

3. The support of claim 1, wherein said copolymer consists essentially of said monomers (I), (II) and (IV).

4. The support of claim 1, wherein said copolymer consists essentially of said monomers (I), (II), (III) and (IV).

5. The support of claim 1, wherein said monomer (III) is present in an amount of 5 to 45% by weight and said monomer (IV) is present in an amount of 5 to 50% by weight based on the weight of said copolymer.

6. The support of claim 1, wherein said monomer (I) is present in an amount of 10 to 35% by weight, said monomer (II) is present in an amount of 15 to 40% by weight, said monomer (III) is present in an amount of 10 to 30% by weight and said monomer (IV) is present in an amount of 10 to 30% by weight based on the weight of said copolymer.

7. The support of claim 2 wherein said monomer (I) is present in an amount of 10 to 35% by weight based on the weight of said copolymer.

8. The support of claim 7, wherein said monomer (III) is present in an amount of 10 to 30% by weight based on the weight of said copolymer.

9. The support of claim 3, wherein said monomer (I) is present in an amount of 10 to 35% by weight based on the weight of said copolymer.

10. The support of claim 9, wherein said monomer (IV) is present in an amount of 10 to 30% by weight based on the weight of said copolymer.

* * * * *